US012698940B2

(12) United States Patent
Clarke et al.

(10) Patent No.: US 12,698,940 B2
(45) Date of Patent: Aug. 4, 2026

(54) HEAT TRANSFER SYSTEM

(71) Applicant: Schlumberger Technology Corporation, Sugar Land, TX (US)

(72) Inventors: Andrew Clarke, Cambridge (GB); Debora Campos de Faria, Cambridge (GB); David Snoswell, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 46 days.

(21) Appl. No.: 18/830,943

(22) Filed: Sep. 11, 2024

(65) Prior Publication Data

US 2025/0093110 A1 Mar. 20, 2025

(30) Foreign Application Priority Data

Sep. 14, 2023 (GB) ..... 2314042

(51) Int. Cl.
*F28F 3/02* (2006.01)
*F28F 13/12* (2006.01)

(52) U.S. Cl.
CPC ..... *F28F 3/02* (2013.01); *F28F 13/12* (2013.01); *F28F 2250/08* (2013.01)

(58) Field of Classification Search
CPC ..... F28D 1/035
See application file for complete search history.

(56) References Cited

U.S. PATENT DOCUMENTS

| | | | | |
|---|---|---|---|---|
| 4,111,189 | A | 9/1978 | Dizon | |
| 9,964,366 | B2 | 5/2018 | Koizuka | |
| 2006/0120213 | A1* | 6/2006 | Tonkovich | B01F 25/31425 366/144 |
| 2024/0258199 | A1* | 8/2024 | Nie | H10W 40/73 |

FOREIGN PATENT DOCUMENTS

| | | | | |
|---|---|---|---|---|
| CN | 110986239 | A | 4/2020 | |
| CN | 111446221 | A | 7/2020 | |
| CN | 111463179 | A | 7/2020 | |
| CN | 111928687 | A * | 11/2020 | F28F 9/22 |

OTHER PUBLICATIONS

"FluxDril—Direct emulsion fluid", Retreived from the internet: https://www.slb.com/-/media/files/mi/product-sheet/fluxdril-ps.ashx, Retreived date: Sep. 24, 2025, 1 Page.
"Slurryice manual", Environmental Process System Limited, Retreieved date: Sep. 24, 2025, pp. 1-31.

(Continued)

*Primary Examiner* — Jianying C Atkisson
*Assistant Examiner* — Khaled Ahmed Ali Al Samiri
(74) *Attorney, Agent, or Firm* — Jeffrey D. Frantz

(57) ABSTRACT

A heat transfer device, such as a heat exchanger, has dimensions and flow speed such that Reynolds number for the flow is in a range from 1 to 1000. The device uses a working fluid which is in a state of elastic turbulence. This enhances transfer of heat to or from the working fluid. In some embodiments the fluid is an emulsion with a disperse phase which changes between liquid and solid so that its latent heat of fusion contributes to the amount of heat carried by the working fluid.

14 Claims, 10 Drawing Sheets

(56) References Cited

OTHER PUBLICATIONS

Abed, W. M. et al., "Experimental investigation of the impact of elastic turbulence on heat transfer in a serpentine channel", Journal of Non-Newtonian Fluid Mechanics, May 1, 2016, vol. 231, pp. 68-78.
Abhat, A., "Low temperature latent heat thermal energy storage: Heat storage materials", Solar Energy, May 18, 1982, vol. 30, pp. 313-332.
Aboul-Eneim, S. et al., "Thermophysical properties of heat-of-fusion storage materials for cooling applications", Renewable Energy, Sep. 19, 1991, vol. 1, pp. 791-797.
Akeiber, H. et al., "A review on phase change material (PCM) for sustainable passive cooling in building envelopes", Renewable and Sustainable Energy Reviews, Jul. 1, 2016, vol. 60, pp. 1470-1497.
Ayel, V. et al., "Rheology, flow behaviour and heat transfer of ice slurries: a review of the state of the art", International Journal of Refrigeration, Jan. 2003, vol. 26, pp. 95-107.
Chen, X. et al., "Carbon-Based Composite Phase Change Materials for Thermal Energy Storage, Transfer, and Conversion", Advanced Science, Mar. 3, 2021, vol. 8, 38 Pages.
Clarke, A. et al., "How Viscoelastic Polymer Flooding Enhances Displacement Efficiency", SPE Asia Pacific Enhanced Oil Recovery Conference, Aug. 11, 2015, pp. 1-21.
Clarke, A., "Mechanism of Anomalously Increased Oil Displacement with Aqueous Viscoelastic Polymer Solutions", Soft Matter, Mar. 23, 2015, vol. 11, pp. 3536-3541.
Clausse, D. et al., "Freezing Within Emulsions: Theoretical Aspects and Engineering Applications", Oil Gas Science and Technology, Dec. 4, 2013, vol. 69, Issue 3, pp. 415-434.
Dalmazzone, C. et al., "Application of DSC for Emulsified System Characterization", Oil Gas Science and Technology, Sep. 1, 2009, vol. 64, pp. 543-555.
Dong Yang Li et al., "Efficient heat transfer enhancement by elastic turbulence with polymer solution in a curved microchannel", Microfluidics and Nanofluidics, Jan. 7, 2017, vol. 21, pp. 1-13.
Egolf, P. W. et al. "Thermodynamics and heat transfer of ice slurries", International Journal of Refrigeration, Jul. 16, 2004, vol. 28, pp. 51-59.
Fardin, M. A., et al., "Elastic turbulence in shear banding wormlike micelles", arXiv:1004.4662v1, Apr. 26, 2010, pp. 1-5.
Groisman, A.et al., "Elastic turbulence in a polymer solution flow", Nature, Feb. 4, 2008, vol. 405, pp. 53-55.
Hauptmann, A. et al., "Does the emulsification procedure influence freezing and thawing of aqueous droplets", The Journal of chemical physics, vol. 145, Oct. 28, 2016, pp. 1-14.
He, B. et al., "Liquid-solid phase equilibrium study of tetradecane and hexadecane binary mixtures as phase change materials (PCMs) for comfort cooling storage", Fluid Phase Equilibria, Sep. 15, 2003, vol. 212, pp. 97-109.
He, B. et al., "Phase transition temperature ranges and storage density of paraffin wax phase change materials", Energy, Sep. 2004, vol. 29, pp. 1785-1804.
Howe, A. M. et al., "Flow of concentrated viscoelastic polymer solutions in porous media: effect of MW and concentration on elastic turbulence onset in various geometries", Soft Matter, Jul. 8, 2015, vol. 11, pp. 6419-6431.
Huang L. et al., "Experimental study on heat capacity of paraffin/water phase change emulsion", Energy Conversion and Management, Jun. 1, 2010, vol. 51, pp. 1264-1269.
Huang, Li et al., "Evaluation of paraffin/water emulsion as a phase change slurry for cooling applications", Energy, May 30, 2009,vol. 34, pp. 1145-1155.
Kitamoto, D. et al., "Remarkable Antiagglomeration Effect of a Yeast Biosurfactant, Diacylmannosylerythritol, on Ice-Water Slurry for Cold Thermal Storage", Biotechnology Progress, 2001, pp. 362-365, vol. 17.
Kitanovski, A. et al., "The fluid dynamics of ice slurry", International Journal of Refrigeration, Jul. 16, 2004, pp. 37-50, vol. 28.
Lu, W. et al., "Experimental study of the thermal characteristics of phase change slurries for active cooling", Applied Energy, Mar. 2012, vol. 91, pp. 366-374.
Mcclements, D. J. et al., "Critical review of techniques and methodologies for characterization of emulsion stability", Critical Reviews in Food Science and Nutrition, Oct. 16, 2007, vol. 47, pp. 611-649.
Minnea A.A., "State of the Art in PEG-Based Heat Transfer Fluids and Their Suspensions with Nanoparticles", Nanomaterials, Jan. 3, 2021, vol. 11, pp. 1-12.
Mitchell, J. et al., "Viscoelastic polymer flows and elastic turbulence in three-dimensional porous structures", Soft Matter, 2016, vol. 12, pp. 460-468.
Noel, J. A. et al., "Phase Change Materials", Storing Energy, Apr. 27, 2016, pp. 503-535.
Palacios, A. et al., "Thermal conductivity measurement techniques for characterizing thermal energy storage materials—A review", Renewable and Sustainable Energy Reviews, Mar. 26, 2019, vol. 108, pp. 32-52.
Paunovic, I, "Solid-liquid phase behavior of mixtures of n-alkanes", University of Calgary, Jun. 1999, pp. 156-160.
Shaikh, S. et al., "Carbon nanoadditives to enhance latent energy storage of phase change materials", Journal of Applied Physics, May 1, 2008, vol. 103, 8 Pages.
Sjoblom, J., et al., "Dielectric Spectroscopy and Emulsions. A Theoretical and Experimental Approach", Journal of Dispersion Science and Technology, vol. 15, Issue 4, Jun. 22, 2010, pp. 401-241.
Wang, F. et al., "A comprehensive review on phase change material emulsions: Fabrication, characteristics, and heat transfer performance", Solar Energy Materials and Solar Cells, Mar. 2019, vol. 191, pp. 218-234.
Xiang, D. et al., "Investigation on the Thermal Conductivity of Mineral Oil-Based Alumina/Aluminum Nitride Nanofluids", Materials, Dec. 16, 2019, vol. 12, pp. 1-9.
Xie N. et al., "Inorganic Salt Hydrate for Thermal Energy Storage", Applied Sciences, Dec. 18, 2017, pp. 1317, vol. 7.
Zalba, B. et al., "Review on thermal energy storage with phase change: materials, heat transfer analysis and applications", Applied Thermal Engineering, Feb. 1, 2003, vol. 23, pp. 251-283.

* cited by examiner

HEAT TRANSFER SYSTEM

CROSS-REFERENCE TO RELATED APPLICATIONS

The subject disclosure claims priority from GB Application No.: GB 2314042.9, filed on Sep. 14, 2023, herein incorporated by reference in its entirety.

FIELD

This disclosure is concerned with heat exchange and with working fluids for apparatus used in management of heat energy by storing heat, absorbing heat or transferring heat energy from one location to another.

BACKGROUND

Various forms of apparatus use a working fluid to absorb heat and transfer the heat to another location. An example is a heat exchange circuit. Another example is a solar water heating system in which solar energy heats a working fluid which in turn heats domestic hot water. A working fluid may also be used to receive and store heat energy when that energy is available and give up the heat at a later time. There are also systems where heat is taken from a working fluid and the cooled fluid is used to absorb heat at a later time. Such working fluids are often water or an aqueous solution or may be some other single-phase liquid.

SUMMARY

This summary is provided to introduce concepts that will be further elaborated and described below in the detailed description. This summary is not intended to identify key or essential features of the claimed subject matter, nor is it intended to be used as an aid in limiting the scope of the claimed subject matter.

One aspect of the present disclosure is a method of moving heat into or out of a flowing fluid, comprising pumping the fluid through a heat transfer device which comprises a chamber for through flow of fluid and wherein a chamber wall in contact with the flowing fluid is an interface through which heat energy is transferred to or from the flowing fluid, wherein the chamber contains an array of spaced obstructions compelling the streamlines of the flowing fluid to repeatedly change direction in order to flow through gaps between the obstructions; the viscosity of the fluid, the flow rate of the fluid within the chamber and the width of the gaps between obstructions gives a Reynolds number (Re) for the flow which is in a range from 1 to 1000, possibly 1 to 100, 1 to 250 or 1 to 500; the fluid contains a solute which enables the fluid to display elastic turbulence; and the flow rate of the fluid through the chamber is such that the flowing fluid is in a state of elastic turbulence.

A system for moving heat energy may comprise a heat transfer device including a chamber for through flow of fluid wherein a chamber wall is an interface through which heat energy is transferred to or from the flowing fluid, a fluid and a pump for pumping the fluid through the chamber, wherein the chamber contains an array of spaced obstructions compelling the streamlines of flowing fluid to repeatedly change direction in order to flow through gaps between the obstructions; the fluid contains a solute which enables the fluid to display elastic turbulence; and the system is configured so that the viscosity of the fluid, the flow rate of the fluid within the chamber and the width of the gaps between obstructions gives a Reynolds number (Re) for the flow which is in a range from 1 to 1000, possibly 1 to 500, 1 to 250 or 1 to 100.

In some embodiments, the heat transfer device is part of a heat exchange system comprising a second heat transfer device at a different location, a pump and pipework connecting the pump and the heat exchange devices as a closed circuit containing the said fluid.

The obstructions may be a plurality of pillars extending across the chamber from the interface to another wall of the chamber. The pillars may be arranged so that flow through gaps between pillars in a row is compelled to change direction by pillars in an adjacent row.

In another aspect, this disclosure provides a working fluid for a heat exchange system wherein the working fluid is a multi-phase system with a continuous phase and at least one suspended disperse phase which changes between solid and liquid at temperatures where the continuous phase is liquid and wherein the continuous phase is a solution containing a solute which enables the continuous phase, and thereby the overall working fluid composition, to display elastic turbulence.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

Figure 1:
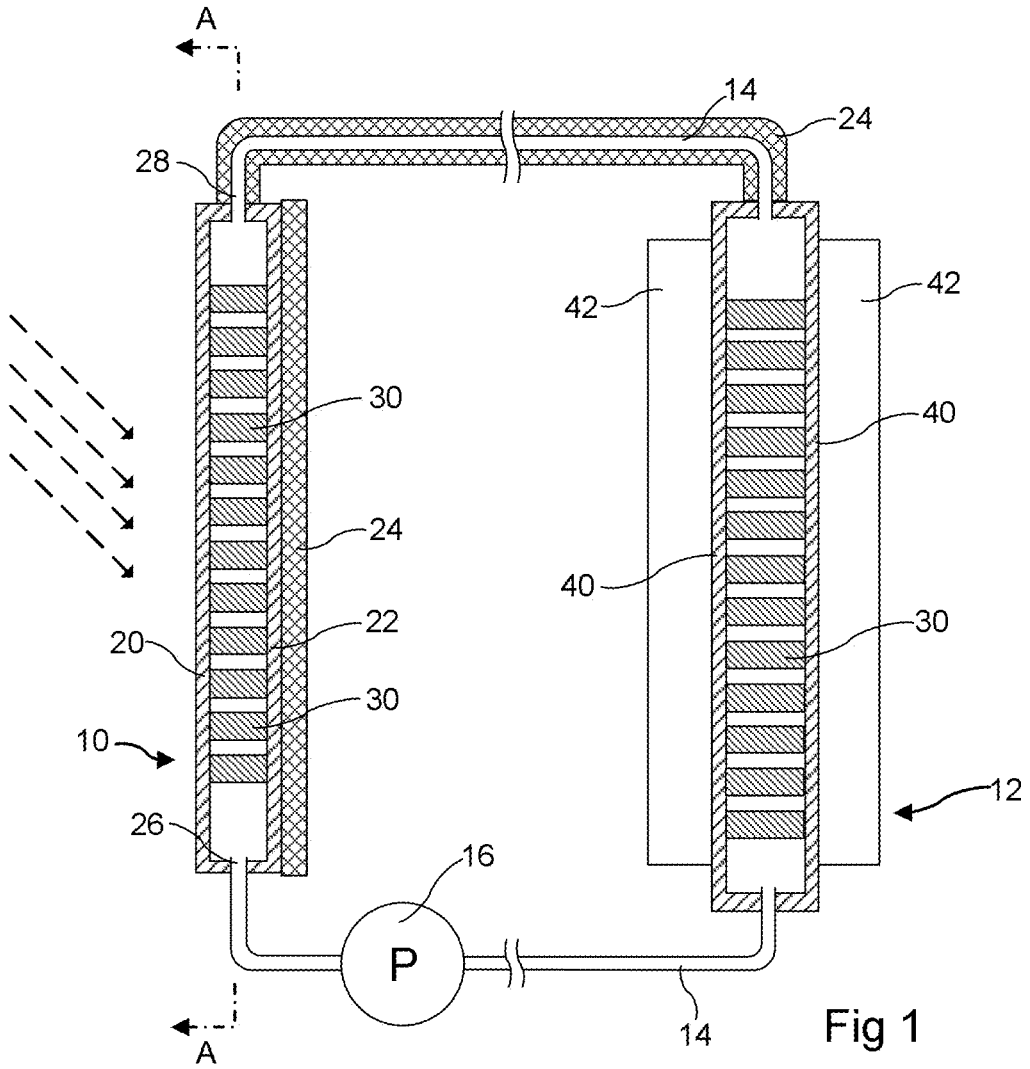
FIG. 1 is a diagrammatic view of a heat transfer system with two devices for heat transfer, both of which are shown as cross sections.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

This detailed description refers to embodiments of the present disclosure and possibilities which may be used. It should be appreciated that features or possibilities described in combination may, where it is practical to do so, be used individually. Also, features or possibilities described in any embodiment may be used in any other embodiment, in so far as it is possible to do so.

The present disclosure uses the phenomenon of elastic turbulence. It is of course well known that Newtonian fluids such as water can undergo either laminar flow or turbulent flow. Such turbulent flow may be referred to as inertial turbulence. Conditions for laminar and turbulent flow are often expressed by Reynolds number which is a ratio of inertial to viscous forces within a fluid. Reynolds number has no dimensions because it is a ratio. At Reynolds number above about 2000 there is inertial turbulent flow. At Reynolds number below about 1500 a Newtonian fluid is in a state of laminar flow.

Elastic turbulence is a different physical phenomenon discovered at the end of the twentieth century. It has been observed at low flow speeds where Reynolds number is low and a Newtonian fluid would be in a state of laminar flow. Elastic turbulence has sometimes been referred to using the older and more general term "elastic instability".

A number of documents have mentioned possible use of elastic turbulence in microfluidics, where dimensions of flow paths and rates of flow are so small that apparatus has a volume below 10 ml and Reynolds number is vanishingly small, far below one. In contrast with that, the present disclosure uses elastic turbulence in equipment where dimensions of the apparatus and rates of flow are large enough that Reynolds number is one or more but less than one thousand. When Reynolds number is in this range, the flow of a Newtonian fluid such as pure water is laminar. As already mentioned, a heat exchange device in accordance with this disclosure has a chamber for the through flow of a fluid which displays elastic turbulence as it flows through the chamber. The fluid volume within this chamber may be at least 50 ml (possibly in experimental apparatus) and may be more, such as at least one liter or at least fifty liters in larger scale equipment.

The formula which may be used to determine Reynolds number for flow through a chamber containing obstructions so as to compel the flow stream lines to bend is:

$$Re = \frac{\rho UL}{\eta}$$

where ρ is density of the fluid in kilograms per cubic metre

U is the flow velocity in metres per second

L is the width of the gaps between the obstructions in the chamber

η is the viscosity of the fluid in Pascal·sec.

If the flow rate is measured as volume in unit time, the formula above becomes $$Re = \frac{\rho QL}{\eta A}$$

where Q is the flow rate in cubic metres per second and A is the cross sectional area, transverse to the overall direction of flow, through which the flow passes.

Elastic turbulence occurs in solutions containing a solute which has a flexible structure. One category of material able to undergo elastic deformation and enable a solution to display elastic turbulence is a polymer containing long flexible linear chains. The number of monomer units in the polymer may be at least 5000 and may be considerably more such as at least 25,000. The monomer units may be present in linear chains of at least 1000 monomer units which may each be connected one to the next by a single covalent bond, so that one monomer unit can rotate relative to adjoining monomer units. Individual linear chains may be longer and a polymer may contain a linear chain of at least 5000 or even at least 10,000 monomer units. The mean molecular weight of the polymer may be 10° Daltons or more. The concentration of such long chain/high molecular weight polymer included in a solution for enabling elastic turbulence to occur may be under 5% by weight, for instance in a range from 0.05% or 0.1% up to 1% or 2% by weight.

A long chain polymer which enables elastic turbulence to occur may be a polymer of a single monomer or may be a copolymer of more than one monomer, for instance a block copolymer which is linear. A polymer may include side chains attached to a long chain of monomer units which are connected together by single covalent bonds. A polymer may include some chain branching, for instance at branch points where three or more chains, each of at least 1000 monomer units and possibly at least 2000 or 5000 monomer units, are connected together.

The flexibility of the polymer chains enables the polymer molecules to become entangled. The flexibility of polymer chains can be described by means of a mathematical model. The freely jointed chain model is commonly used and the flexibility of a particular polymer can be indicated by parameters of an equivalent freely jointed chain (itself a mathematical model). A description of this approach is provided by Chapter 2 of "Polymer Physics" by Rubinstein and Colby, 2003, Oxford University Press. An equivalent freely jointed chain has the same mean-square end-to-end distance and the same maximum end-to-end distance as the actual polymer but is considered to consist of so-called Kuhn monomers which are freely rotatable relative to each other. These model monomers have a length, termed the Kuhn length, and a molar mass.

Polymers which enable elastic turbulence to occur may contain at least one flexible polymer chain with length and composition represented by at least 1000 Kuhn monomers having a Kuhn length not more than 100 Angstroms (10 nm) and possibly not more than 50 Angstroms. If a polymer is a single, unbranched chain, its length and composition may be represented by at least 5,000 Kuhn monomers having a Kuhn length not more than 100 Angstroms and possibly considerably more, such as at least 20,000 Kuhn monomers of such Kuhn length.

Elastic turbulence has been observed with several different long chain polymers in solution. One such polymer is polyacrylamide, which may be hydrolyzed or partially hydrolyzed. Experimental evidence for elastic turbulence in a solution of high molecular weight polyacrylamide was given by Groisman and Steinberg in "Elastic Turbulence in a polymer solution flow" Nature, Vol 45 p53 (2000). Other instances of long chain polymers reported to give rise to elastic turbulence include polyisobutylene of molecular weight 4 to 6 Megadaltons dissolved in an organic solvent (Dris and Shaqfeh, J. Non-Newtonian Fluid Mech. Vol 80 pages 1 to 58 (1998)), polystyrene of molecular weight 18 Megadaltons in an organic solvent (Magda and Larson, J. Non-Newtonian Fluid Mech. Vol 30 pages 1-19 (1988)) and polyethylene oxide of molecular weight 4 MegaDaltons in an aqueous solution (Davoodi et al, J. Fluid Mech, Vol 857, pages 823-850 (2018)). Kuhn lengths for polystyrene and polyethylene oxide given by Rubinstein and Colby, as 15 to 25 Angstroms (Fetters, Lohse and Colby, Chain Dimensions and Entanglement Spacings. In Physical Properties of Polymers Handbook; Mark, J. E., Ed.; Springer: New York, 2007; pages 447-454).

When using a long chain linear polymer to enable elastic turbulence to occur, it is desirable to include a biocide to protect the polymer from biodegradation.

Long chain partially hydrolyzed polyacrylamide linear polymers with a molecular weight of more than 1 MegaDalton are available from SNF Floerger, whose headquarters are in Andrézieux, France.

Elastic turbulence has also been observed with solutions containing a surfactant which forms worm-like micelles in solution. There is extensive scientific literature concerning surfactants which form worm-like micelles, their properties and applications. One review is Yang "Viscoelastic worm-like micelles and their applications" Current Opinion in Colloid & Interface Science vol 7 pages 276-281 (2002). Discussions of properties include Raghavan and Kaler "Highly Viscoelastic Wormlike Micellar Solutions Formed by Cationic Surfactants with Long Unsaturated Tails" Langmuir vol 17, pages 300-306 (2001) and Beaumont et al "Turbulent flows in highly elastic wormlike micelles" Soft Matter vol 9 page 735 (2013). An example, using cetyl trimethyl bromide as the surfactant, is mentioned by Favolin et al in Physical Review Letters Vol 104 178303 (2010).

When a solution contains a substance able to cause elastic turbulence, the phenomenon of elastic turbulence occurs if the solution is flowing at a sufficient flow velocity (which may be a low velocity) and the path of flow causes the streamlines of the flow to curve. Consequently, one known possibility for a flow path which induces elastic turbulence is a serpentine channel. Another possibility is described below with reference to the drawings. A detailed discussion of elastic turbulence is provided by Steinberg in Annual Review of Fluid Mechanics, vol 53, pages 27-58 (2021).

The ability of a fluid composition to display elastic turbulence can be demonstrated with laboratory apparatus, as mentioned below. A flow rate through a heat exchange device which is sufficient for a selected fluid composition to display elastic turbulence can be found by experiment, as is also shown below.

In the present disclosure, the elastic turbulence mixes the working fluid as it flows over a solid interface through which heat is transferred into or out of the working fluid. As a consequence of the elastic turbulence, the rate of heat transfer is increased because the heat transfer to or from the interface is not restricted to the conduction of heat through the working fluid.

As an example embodiment of this disclosure, the drawings show a heat transfer system for transferring heat energy from a heat source to a volume of water. The device 10 at the left of FIG. 1 is exposed so as to be heated by the sun. The device 12 at the right of FIG. 1 is immersed in a body of water. The two devices 10, 12 are joined by piping 14 for circulating working fluid which is pumped around the circuit by pump 16. The section of piping which carries hot working fluid is surrounded by heat insulation 24. The devices 10 and 12, along with piping 14 and pump 16 form a heat exchange circuit for transferring solar heat energy received at the surface 20 to the water surrounding the device 12.

The device 10 has a cuboidal casing defining a chamber through which the working fluid is pumped. The casing face 20 which is exposed to the heat of the sun is the interface between the working fluid inside the casing and the source of heat. This is made of a thermally conductive material, such as copper or aluminum. The opposite surface 22 has heat insulation 24 against it to reduce heat loss.

Figure 2:
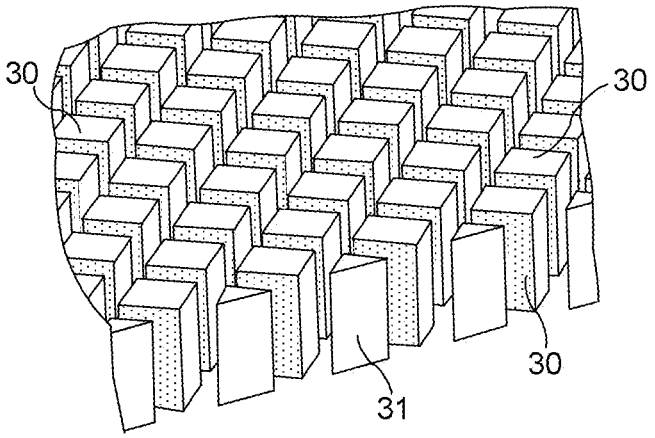
FIG. 2 shows part of an array of pillars, as used in the heat transfer devices of FIG. 1.
Figure 3:
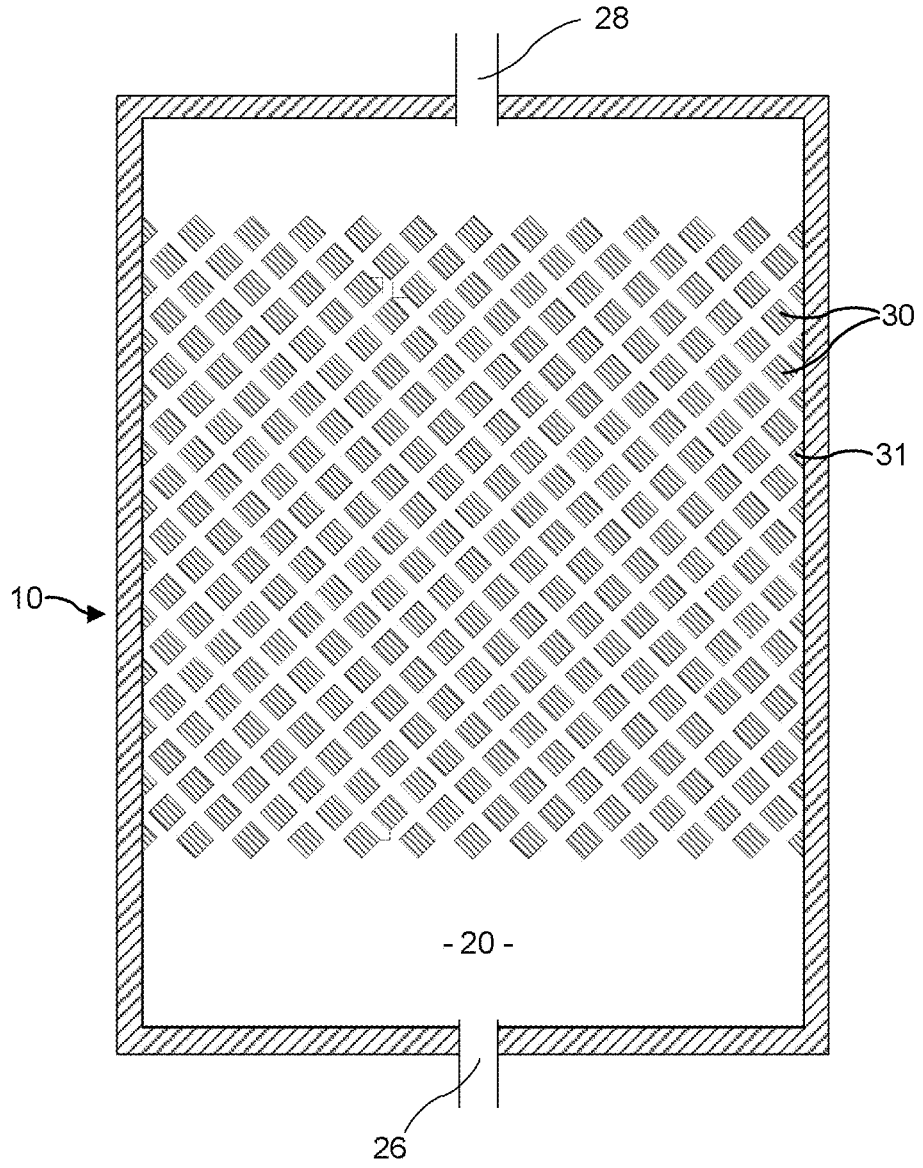
FIG. 3 is a cross section of one heat transfer device, on line A-A of FIG. 1.

Inside the casing of the device 10 is an array of pillars 30 formed by bars which extend from the casing face 20 across the internal chamber to the opposite face 22. FIG. 2 illustrates the arrangement of such pillars 30 as a perspective view from one side, without the enclosing casing 20. FIG. 3 which is a cross section on line A-A of FIG. 1 also shows the arrangement of the pillars 30. As shown by FIG. 3 and the enlargement which is FIG. 4 the pillars 30 have a square cross section with flat faces 32 meeting at corner edges 33 and 34. The width of a flat face 32 is indicated as "a" in FIG. 4 and the spacing between the faces 32 of adjacent pillars is indicated as "b". The width of the gap between two confronting edges 34 is given by Pythagoras theorem as $\sqrt{2}b^2$. As shown in FIG. 3, the edges of the array are completed with pillars 31 which have a triangular cross section. Each pillar 30 is positioned so that the diagonal across the square cross section between corner edges 33 is aligned with the overall direction of flow, i.e. this diagonal is aligned parallel to an imaginary line from the inlet 26 to the outlet 28. The flat faces 32 of each pillar are inclined to this overall direction of flow. As shown by the enlarged view in FIG. 4, working fluid flows through the gaps between confronting edges 34 of adjacent pillars 30, but is then compelled to turn by another pillar. Thus the array of pillars 30 obstructs straight line flow of working fluid, causing the streamlines of the flow indicated with broken lines in FIG. 4 to bend repeatedly.

The heat exchange device 12, which is immersed in water to be heated, has a cuboidal casing 40 which is the interface through which heat energy leaves the working fluid. Fins 42 projecting from the casing 40 assist the conduction of heat from the casing 40 to the surrounding water.

The interior of the device 12 is similar to the interior of the device 10. The casing 40 defines a chamber for the through flow of working fluid. Bars which extend across the interior chamber from one side face to the other provide an array of pillars 30 obstructing flow just as described for the device 10.

Figure 5:
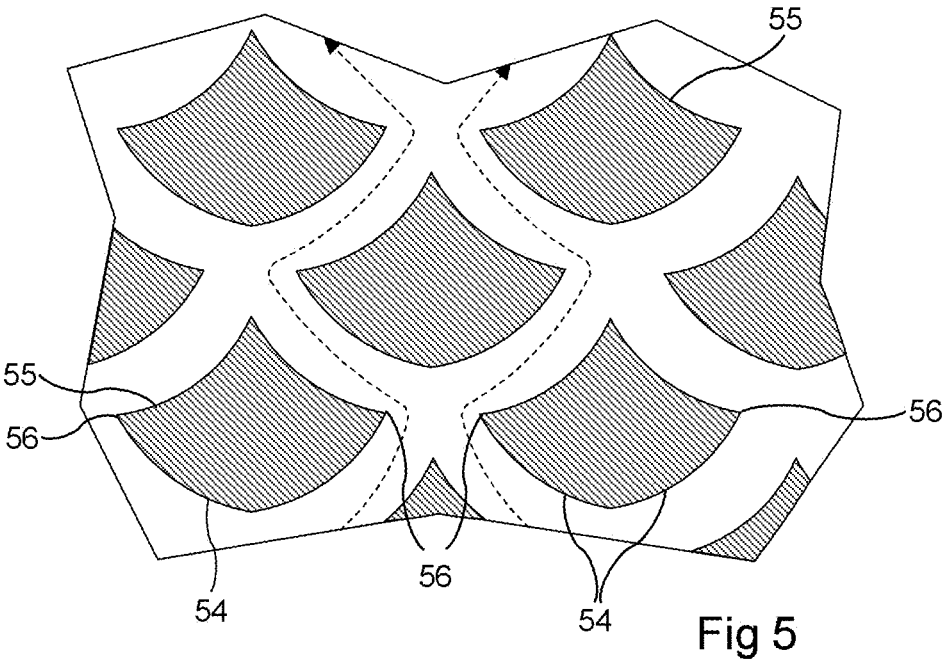
FIG. 5 is a similar view to FIG. 4, showing pillars with a different cross section.

FIG. 5 shows another possible cross section for pillars 30. The surfaces 54 have convex curvature and intersect concave surfaces 55 at edges 56. Fluid flows through the gaps between edges 56 as shown by the broken lines and is compelled by the arrangement of pillars to change direction as it does so.

The working fluid circulated through the heat exchange devices 10 and 12 may be an aqueous solution of a long chain partially hydrolyzed polyacrylamide linear polymer with a molecular weight of more than 1 MegaDalton and possibly more than 3, or 5 or 10 MegaDaltons, Its concentration may be no more than 5% by weight and may possibly be no more than 1% by weight. Such polymers are available from SNF Floerger, whose headquarters are in Andrézieux, France. The working fluid also contains a small concentration of a biocide to prevent biological degradation of this polymer.

The circulating pump 16 propels the working fluid at a flow rate such that flow entering at the device 10 at its inlet 26 is laminar and flow entering the device 12 is also laminar.

This flow rate is such that as the working fluid flows through the arrays of pillars within the devices 10 and 12 it is in a state of elastic turbulence. In the device 10 this has the effect of transferring heat energy from the casing surface 20 to the working fluid more rapidly than would be transmitted by conduction under conditions of laminar flow without elastic turbulence. Similarly, in the device 12, elastic turbulence increases the rate of transfer of heat from the working fluid to the casing 40 of the device 12, from which the heat energy passes on to the water surrounding the device 12.

The ability of a solution to display elastic turbulence can be shown experimentally. In a cone and plate rheometer cell, the onset of elastic instability with application of increasing shear is observed as an apparent increase in viscosity at a particular shear rate associated with an abrupt increase in the noise in the measured torque signal. This has been described by D. O. Olagunju, "Instabilities and bifurcations of von Karman similarity solutions in swirling viscoelastic flow", Z angew Math Phys, 46 (1995) 224-238 and also by E. Tran, A. Clarke, "The relaxation time of entangled HPAM solutions in flow", Journal of Non-Newtonian Fluid Mechanics, 311 (2023) 104954).

Figure 6:
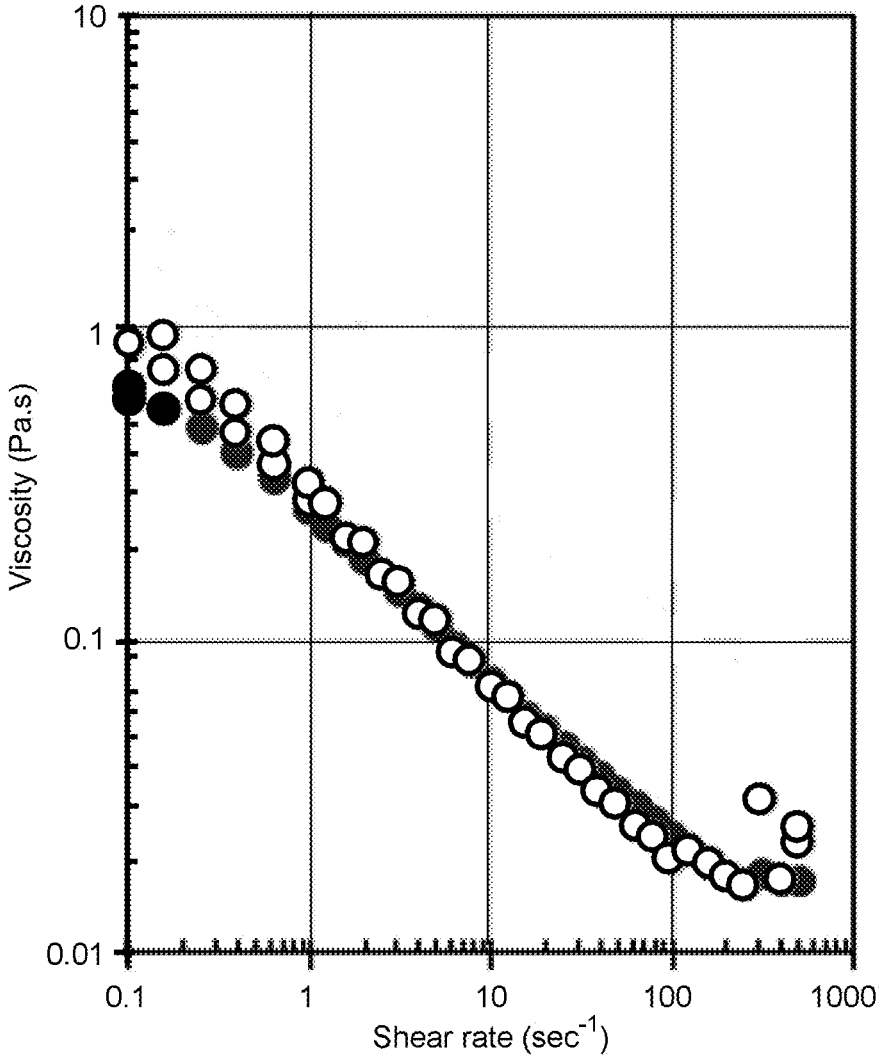
FIG. 6 is a plot of experimental results showing onset of elastic turbulence.

FIG. 6 is a plot of viscosity against increasing shear rate for two aqueous solutions containing 0.456 wt % sodium chloride, a small percentage of a linear polyacrylamide with molecular weight above 10 MegaDaltons and a few drops of a biocide consisting of isopropanol and thiourea. In one of these aqueous solutions the polyacrylamide was 0.24 wt % of Flopaam3630 from SNF Floerger which has mean molecular weight of 18 to 20 MegaDaltons. In the other aqueous solution the polyacrylamide was 0.2 wt % of Flopaam 6040, also from SNF Floerger, with a mean molecular weight between 25 and 30 MegaDaltons. For both solutions, the onset of elastic turbulence with increasing shear rate can be seen as the change in slope of the plotted curve at about 150 $s^{-1}$. (With heat transfer devices shown in FIGS. 1 to 4, the shear rate for the onset of elastic turbulence would be less). Additional experimental work demonstrating elastic turbulence in polymer solution and in a solution of viscoelastic surfactant is described below with reference to FIGS. 14 and 15.

Figure 7:
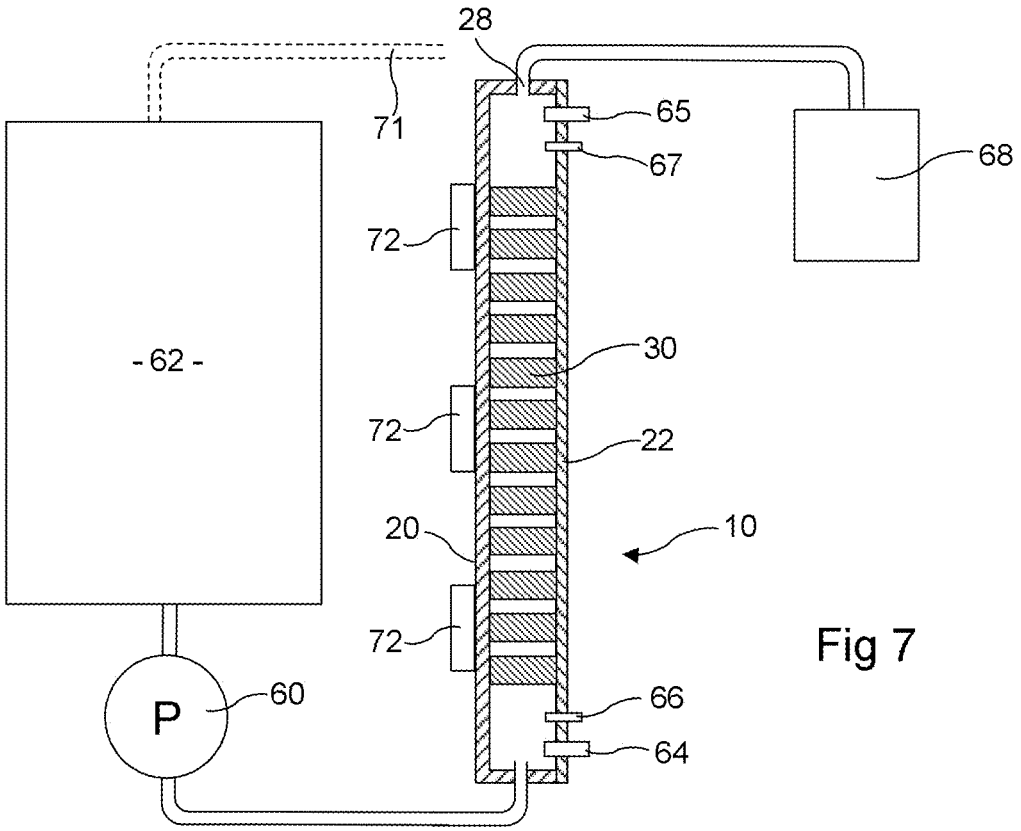
FIG. 7 is a diagrammatic view of apparatus to determine operating parameters for the system of FIGS. 1 to 3.

A minimum flow rate required to cause elastic turbulence in a heat exchange device and the rate of heat transfer to or from the circulating working fluid can both be determined experimentally. Apparatus for this is shown in FIG. 7. In this apparatus the heat exchange device 10 (or a preliminary model for such a device) is connected to a pump 60 which delivers liquid from a tank 62 which is maintained at a fixed temperature. Pressure sensors 64, 65 and temperature sensors 66, 67 are fitted at the inlet and outlet of the device 10. The temperature sensors 66, 67 may be thermocouples. The outlet 28 from the device 10 is connected to a graduated vessel 68 for measuring volume of liquid which has been pumped through the device 10 in a chosen interval of time, and thereby determining the flow rate.

When liquid from the tank 62 is pumped through the device 10 there will be a pressure drop between the inlet pressure sensor 64 and the outlet pressure sensor 65. When the flow rate through the device 10 is very low, the flow will be laminar, without any elastic turbulence. The minimum flow rate to cause elastic turbulence in the device 10 can be found by progressively increasing the pump speed to increase the flow rate and plotting the pressure drop against flow rate or plotting the pump speed, which is indicative of pressure drop, against flow rate. This plot will show a change in slope on reaching the flow rate at which elastic turbulence begins.

Figure 8:
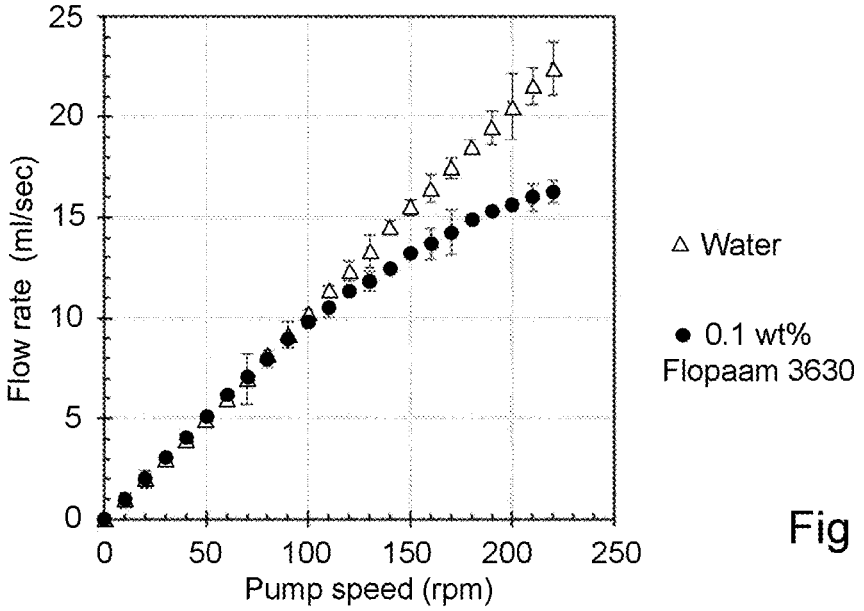
FIGS. 8 to 10 show experimental results obtained with an embodiment of such apparatus.
Figure 9:
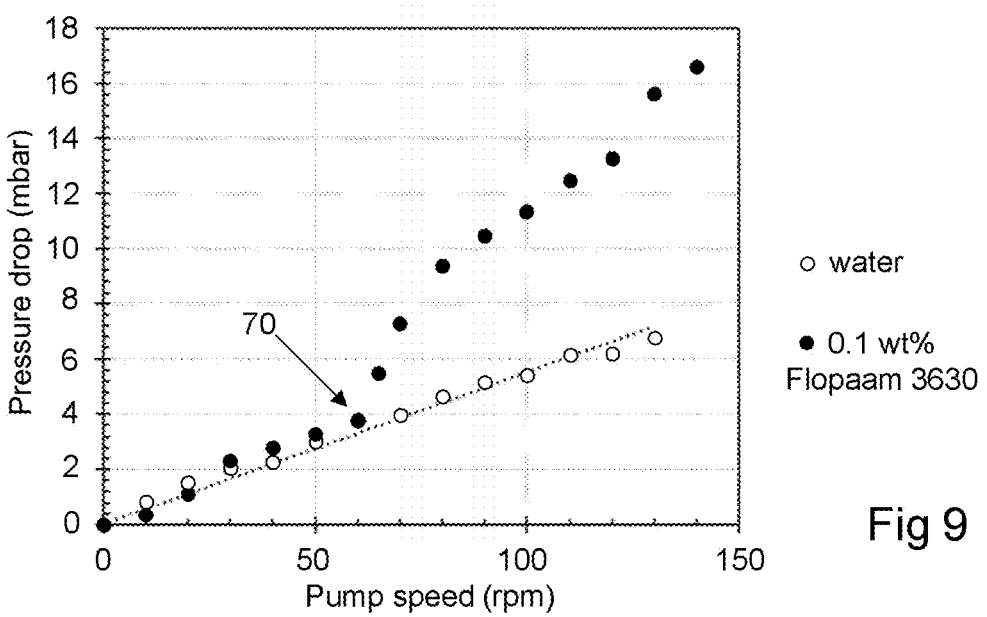

This is illustrated by the following description of experimental work with apparatus as shown in FIG. 7. The results of the experiments are shown in FIGS. 8 and 9. An initial calibration determined relationships between pump speed and flow rate. The tank 62 was filled with water. The pump was used to propel water through the device 10 at progressively increasing flow rate. The pump speeds and the flow rates measured downstream of the device 10 were recorded and are shown in FIG. 8 (triangle points). This calibration procedure was then repeated with an aqueous solution containing 0.1 wt % of Flopaam 3630 polyacrylamide in the tank 62. This gave the non-linear plot also shown in FIG. 8 (circular points).

FIG. 9 shows the measured pressure drops plotted against flow rate. With water the plot was approximately linear (as would be expected because water is a Newtonian fluid) but with the polyacrylamide solution there was a very sharp change in the slope of the plot at the point 70, indicating that the flow rate at this point was the minimum required to cause elastic turbulence with that polyacrylamide solution and device 10.

A calculation of Reynolds number, at a flow rate giving elastic turbulence was as follows:

The flat faces 32 of the pillars had a width "a" of 4 mm and the height of the pillars was 7 mm. The spacing "b" between the faces 32 of adjacent pillars was 2 mm and so the gaps between adjacent edges 34 was $\sqrt{8}$=2.83 mm. A full line of pillars transverse to the overall direction of flow contained 12 pillars with 11 gaps between edges 34, d so the cross section available for flow was:

$$11 \times 7 \times 2.83 \text{ mm}^2 = 11 \times 7.10^{-3} \times 2.83.10^{-3} \text{ m}^2.$$

Flow rate was measured as 75 ml·$sec^{-1}$=7.5×$10^{-5}$ $m^3sec^{-1}$.

Density of the fluid was 1000 kg/$m^3$; dynamic viscosity was 0.008 Pa·sec.

Putting these numbers into the formula mentioned above:

$$Re = \frac{\rho QL}{\eta A} = \frac{1000 \times 7.5.10^{-5} \times 2.83.10^{-3}}{8.10^{-3} \times 11 \times 7.10^{-3} \times 2.83.10^{-3}}$$

which is Re=12.17.

The apparatus of FIG. 7 was also used to observe the rate of heat transfer through the surface 20 and into the device 10. For this, electrical resistors 72 serving as heating elements were fitted to the surface 20. The outlet 28 from the device 10 was connected to the tank 62 along a flow path partially indicated at 71, so that flow was in a closed circuit. A chiller was used to maintain the tank 62 at a fixed temperature.

Measurements were made with the Flopaam 3630 polyacrylamide solution in the flow circuit and also with water in this circuit. Measurements were made at a number of pump speeds. At each pump speed the electrical power to the resistors 72 was increased in steps and the temperature difference between the thermocouples 66, 67 was recorded. For each pump speed, this temperature difference was plotted against the electrical power supplied to the resistors 72. These plots were all linear and the slope of the line was a rate of heating the fluid flowing through the device 10. It was observed that when the flow rate was sufficient to cause elastic turbulence, the rate of heating was considerably increased. Without elastic turbulence the transfer of heat into the flowing fluid was solely conductive. When elastic turbulence was present, the transfer of heat included movement, brought about by the elastic turbulence, of heated fluid away from the surface 20 and into the body of the flowing fluid. In short, when there was elastic turbulence, the heat transfer was convective as well as conductive.

Calculations to show this quantitatively used the Nusselt number which is a dimensionless number indicating ratio of convective heat transfer to conductive heat transfer. The formula for a mean Nusselt number relating to heat transfer between a fluid and a flat, solid surface is:

$$\overline{Nu} = \frac{\dot{m}CW}{kA_s}\frac{(T_{m,o} - T_{m,i})}{\Delta T_{lm}} \tag{13}$$

where $\dot{m}$ is the mass flow rate, k and C are the thermal conductivity and specific heat capacity respectively, $A_s$ and W are geometric parameters of the flow channel (surface area and width). $T_{m,o}$ and $T_{m,i}$ are the outlet and inlet temperatures respectively, and $\Delta T_{lm}$ is the log mean temperature difference defined as;

$$\Delta T_{lm} = \frac{((T_w - T_{m,o}) - (T_w - T_{m,i}))}{\ln\left[\frac{(T_w - T_{m,o})}{(T_w - T_{m,i})}\right]}$$

where $T_w$ is the wall temperature, in this instance the temperature of plate 20 heated by the resistors 72. For each pump speed a ratio of the mean Nusselt number with polyacrylamide solution in the flow circuit and the mean Nusselt number with water in the flow circuit is given by the formula:

$$\frac{\overline{Nu}_{polymer}}{\overline{Nu}_{water}} = \frac{\dot{m}_{polymer}}{\dot{m}_{water}}\left[\frac{\ln[T_{w,polymer} - T_{m,o,polymer}] - \ln[T_{w,polymer} - T_{m,i,polymer}]}{\ln[T_{w,water} - T_{m,o,water}] - \ln[T_{w,water} - T_{m,i,water}]}\right]$$

Figure 10:
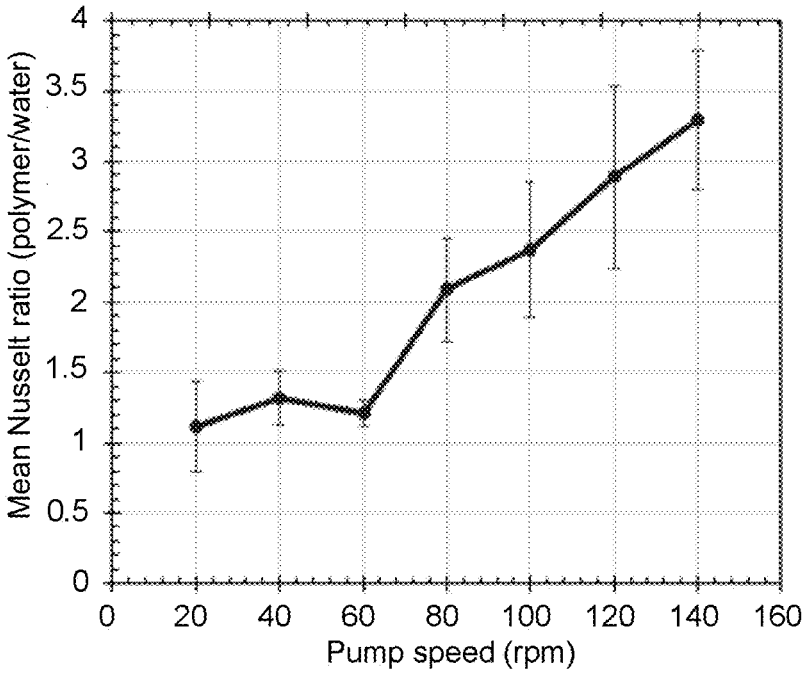

This ratio was calculated for each pump speed and the calculated ratios are shown in FIG. 10. It can be seen that at pump speeds below 62 rpm, where there was no elastic turbulence the ratio was close to one, but above 62 rpm the ratio progressively increased with pump speed, confirming that elastic turbulence was considerably enhancing the rate of heat transfer into the fluid in the flow circuit.

In some embodiments of this disclosure, the working fluid is an emulsion or suspension where the disperse phase is able to melt and to freeze at temperatures where the continuous phase is liquid. Emulsions and suspensions are used extensively in a wide range of commercial products over a wide range of industries. Emulsions are liquid-in-liquid systems with small drops of one liquid (the dispersed phase) distributed within another liquid (the continuous phase). The two liquids may be (and usually are) immiscible. The dispersed phase may be stabilized against coalescence by a surfactant in the composition or possibly by solid particles (smaller than the emulsion droplets) at the interface between the dispersed and continuous phases. An emulsion stabilized with solid particles is sometimes termed a Pickering emulsion. Suspensions have small particles of solid suspended within a continuous liquid phase.

If melting and freezing of the disperse phase of an emulsion take place within a temperature range where the continuous phase is liquid, the disperse phase may freeze and remain as a suspension of solid particles in the continuous phase. Because the continuous phase remains liquid, this suspension remains mobile, capable of flow and pumpable. Such a two-phase liquid is termed a phase change material emulsion (PCME). If a PCME is used as a working fluid for heat exchange or heat storage, with temperatures such that the disperse phase undergoes melting or freezing, the heat-carrying capacity of the fluid includes the latent heat of fusion of the dispersed phase (or the latent heats of the disperse phases if two or more are present and change between solid and liquid) because this latent heat is supplied to cause melting and is given out on freezing.

As an illustration of this, if a unit mass of water with specific heat capacity $c_p^{water}$ is heated from temperature $T_1$ to temperature $T_2$ the enthalpy change is:

$$\Delta E^{water} = c_p^{water}(T_2 - T_1)$$

If unit mass of an emulsion containing proportion $\phi$ of an oil is heated over the same temperature range, and the melting point of the oil is between $T_1$ and $T_2$, the enthalpy change is:

$$\Delta E^{pcm} = \phi\left(L^{oil} + c_p^{oil}(T_2 - T_1)\right) + (1 - \phi)c_p^{water}(T_2 - T_1)$$

where $L^{oil}$ is the latent heat of fusion of the oil and for simplicity it is assumed that the specific heat of the oil is the same for its frozen and liquid forms. In the case of a PCME containing 30 vol % of hexadecane as the disperse phase in water as continuous phase, and with a temperature rise of 15° spanning the melting temperature of the hexadecane, the enthalpy change of the PCME calculated using published values for specific heats and latent heat is 1.97 times that of water alone.

The use of a PCME as working fluid and the use of a working fluid displaying elastic turbulence can work in co-operation with each other. Using a PCME may reduce the volume and/or the flow rate of working fluid required to carry heat without directly altering the rate at which heat is transferred into or out of the working fluid. Indeed, use of a PCME may even reduce the rate at which heat is transferred from or to the working fluid, because the PCME may have lower overall thermal conductivity than its continuous phase. Use of elastic turbulence improves heat transfer at the interface through which heat is carried into or out of the working fluid. and so can reduce the size required for this interface or reduce the required flow rate over this interface and in consequence reduce the required pumping power. Thus the use of a PCME as working fluid jointly with elastic turbulence at the point of heat transfer to or from the working fluid can reduce the size and/or power demand of equipment to transfer heat by means of a flowing working fluid, The continuous phase used for the PCME may be an aqueous solution. However, it could be a non-aqueous liquid such as an organic solvent or a low viscosity polydimethyl siloxane, commonly referred to as low viscosity silicone oil.

The disperse phase or phases of the PCME should not be agglomerated by interaction with the polymer which enables elastic turbulence. A disperse phase may therefore be an organic compound without heteroatoms, such as a paraffinic hydrocarbon, or may be an organic compound in which the only heteroatoms are oxygen atoms in ester or ether groups. It is also possible that a disperse phase is a fluorocarbon.

A number of factors may destabilize emulsions. In particular, so called 'creaming' is a problem encountered when the disperse and continuous phases are of different densities. It refers to the migration of emulsion droplets to the top of the emulsion, resulting in the eventual separation of phases. Emulsions additionally suffer from coalescence, where droplets merge to form larger droplets unless kinetically arrested using surfactants. A polymer which enables elastic turbulence may also stabilize against creaming. A further possibility is to incorporate a second polymer which will not by itself enable elastic turbulence to occur but will slightly enhance viscosity and thereby stabilize the PCME against creaming. More specifically a second polymer may be weakly associative so that a weak or critical gel is formed (i.e. giving the fluid solid-like properties) under quiescent conditions. As soon as flow starts the weak structure is broken and the emulsion flows easily.

The amount of a second polymer included to stabilize the emulsion may be under 5% by weight, and may be in a range from 0.05% or 0.1% up to 1% or 2% by weight, The following experimental work shows a PCME which displays elastic turbulence. The continuous phase was an oil-in-water emulsion containing the following materials:

| Material | Concentration | Function |
|---|---|---|
| Sodium Chloride | 4.55 g/L | Salinity modifier |
| Xanthan | 2.25 g/L | Gelator |
| Polyacrylamide (HPAM) | 0.54 g/L | Elasticity |
| Sodium Dodecyl Sulfate (SDS) | 1.54 g/L | Dispersant |
| Deionised Water | Balance | solvent |

The polyacrylamide was Flopaam 3630 as mentioned above, with molecular weight 18-20 MegaDaltons. The disperse phase was hexadecane.

Preparation of the emulsion began with preparation of three compositions as follows:

1. Xanthan in brine. 0.5 g of xanthan powder was added to 99.5 g of 4.55 g/L NaCl brine. The xanthan was mixed for 5-10 minutes at 5000 rpm with a Silverson L5 lab mixer fitted with a general purpose disintegrating head. The mixed solution was heated to 80° C. with a hotplate and magnetic stirrer and then cooled.
2. Partially hydrolyzed polyacrylamide (HPAM) in brine. 0.12 g of Flopaam 3630S was added to 99.88 g of 4.55 g/l NaCl brine. The mixed solution was stirred with a magnetic stirrer at 200 rpm overnight.
3. Hexadecane emulsion. 46.38 g of hexadecane was added to 153.62 g of a 2 wt % sodium dodecyl sulfate (SDS) solution in 4.55 g/L brine whilst shearing at 6000 rpm in a Silverson L5 mixer fitted with a high shear screen. The droplet size distribution was measured in a Malvern Instruments Mastersizer 3000. The $d_{50}$ parameter for the emulsion droplets was measured as 4.56 μm.

Figure 11:
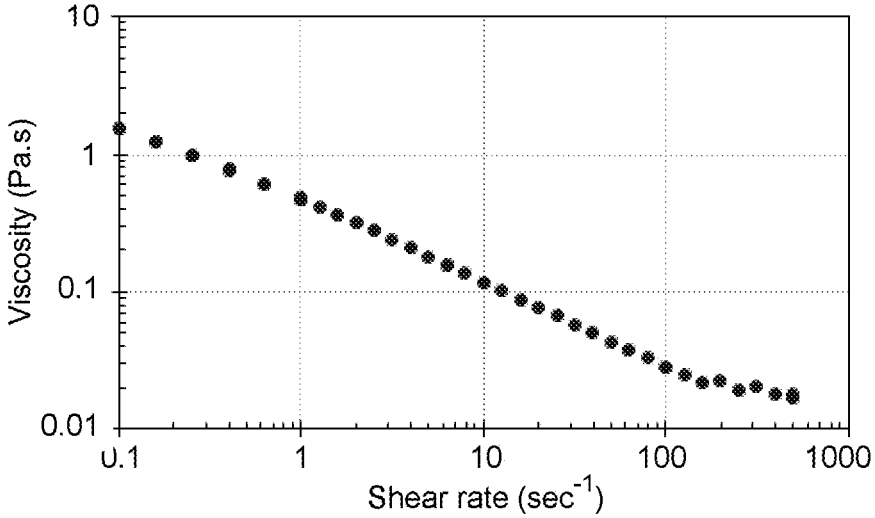
FIGS. 11, 12 and 13 show experimental results relating to elastic turbulence in a phase change emulsion.

The xanthan solution and the HPAM solution were combined in a 1:1 by weight proportion. The combined solution exhibited elastic turbulence which was detected as a rheological flow instability observed with a cone and plate rheometer as mentioned above. FIG. 11 is a plot of viscosity vs shear rate for this example HPAM/Xanthan mixture. In this measurement, made in a rheometer cell, the onset of elastic turbulence with increasing shear rate can be seen at about 150 $s^{-1}$.

The PCME was then made by mixing the combined solution and the hexadecane emulsion. PCME's containing 0.6 vol %, 1.5 vol % and 3 vol % of the initial hexadecane emulsion were observed to be stable to creaming and each exhibited elastic turbulence when tested using a cone and plate rheometer as above. The onset of elastic turbulence on increasing shear rate was again seen at about 150 $s^{-1}$.

Figure 12:
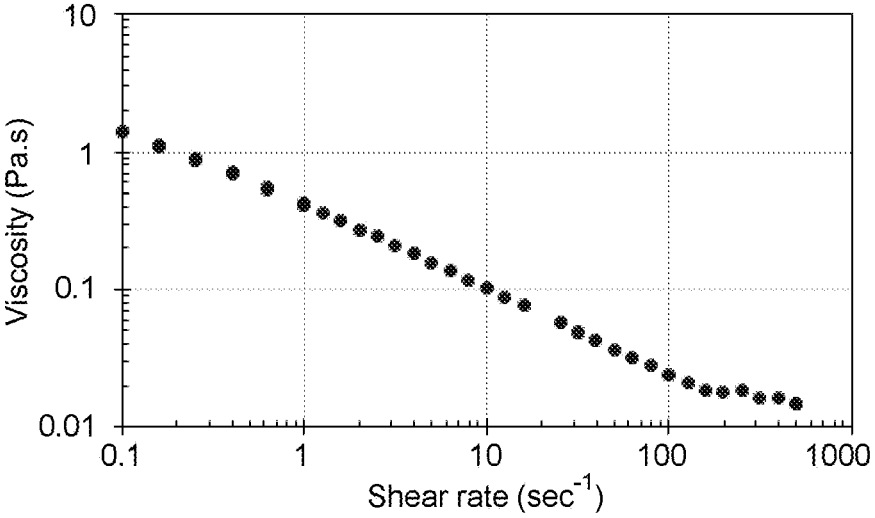
Figure 13:
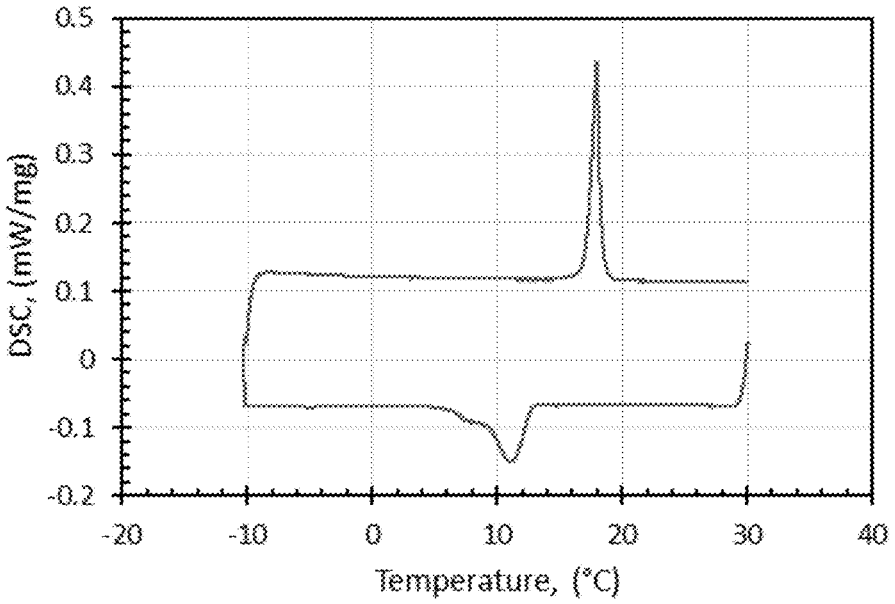

A sample portion of this PCME formulation was examined by differential scanning calorimetry. The results are shown by FIG. 12. The measurement was started at 30° C. and temperature was reduced at 1° C./min. Freezing of the hexadecane droplets occurred at about 11° C. The sample was cooled to −10° C. and was then heated (for this composition at this cooling rate the continuous phase did not freeze). The hexadecane then melted at 18° C.

As an example, a heat exchange circuit as in FIGS. 1 to 3 is used to heat a water supply with an incoming temperature of 5° C. The working fluid is as described above with hexadecane as disperse phase in an aqueous continuous phase containing polyacrylamide and xanthan. The heat exchange device 10 exposed to the sun raises the temperature of the working fluid to at least 25° C. so that the disperse phase is emulsified liquid droplets as it leaves the device 10 through outlet 28 and as it enters the device 12. In the heat exchange device 12 the working fluid is cooled to 10° C., so that the hexadecane disperse phase freezes to suspended solid particles. The working fluid is then pumped again into the device 10 where the solar heat provides the latent heat to melt the frozen hexadecane droplets as well as raising the fluid temperature to 25° C. Consequently, the heat carried from the heat exchange device 10 to the device 12 and given out from the device 12 to the surrounding water comes both from the drop in temperature of the working fluid and the latent heat of fusion given out as the disperse phase solidifies. At the same time the elastic turbulence increases the rates at which heat is carried into and out of the working fluid. As a consequence of these, the heat exchange devices may be smaller than would otherwise be required and the energy used in pumping the working fluid may be less than would be required to pump a working fluid at a flow rate giving inertial turbulence.

Figure 4:
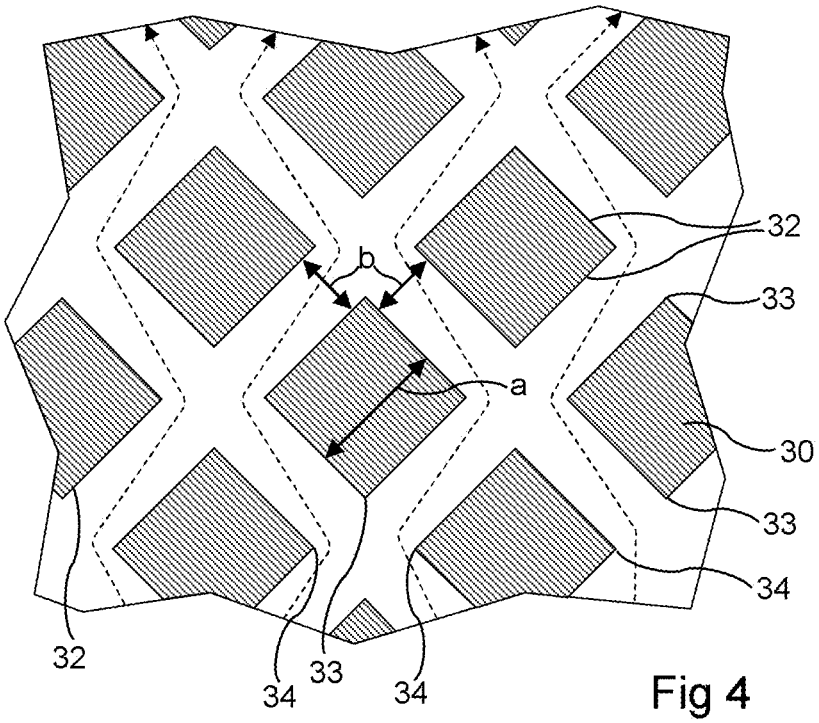
FIG. 4 is an enlargement of part of FIG. 3.
Figure 14:
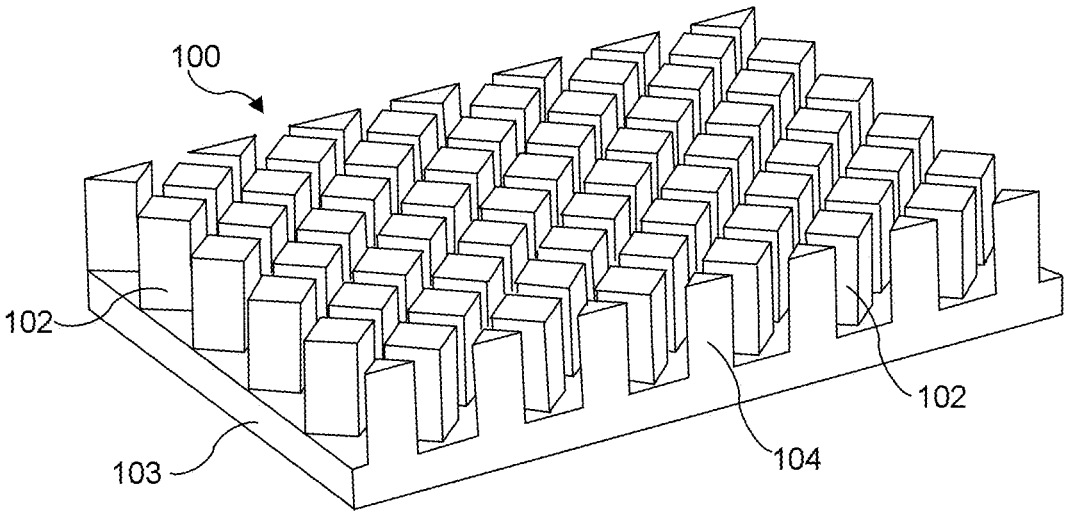
FIG. 14 is a perspective view of a flow guide.
Figure 15:
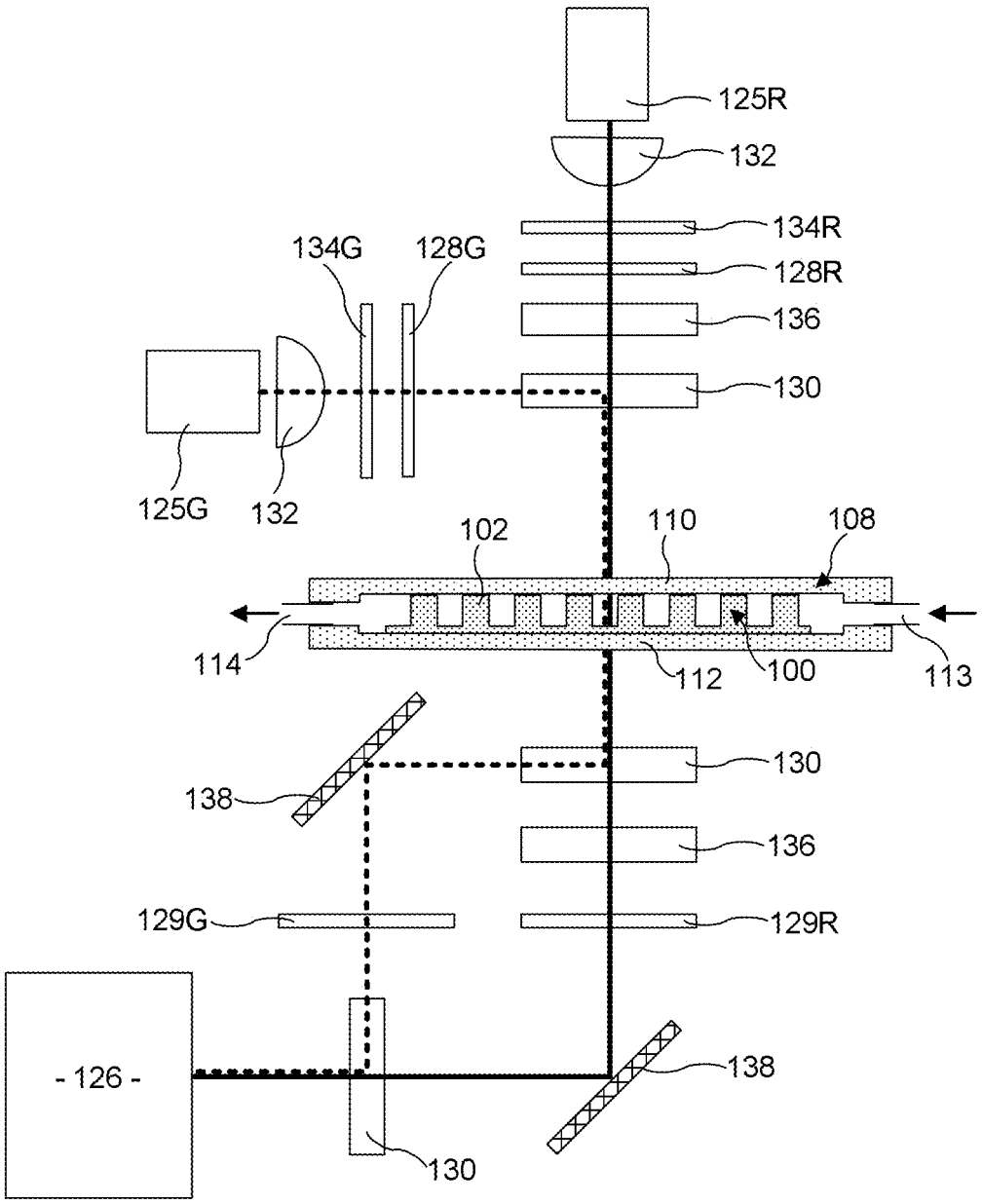
FIG. 15 is a diagram of apparatus for observing elastic turbulence by means of birefringence.

Further demonstrations of elastic turbulence, both when caused by viscoelastic surfactant and when caused by high molecular weight polymer, were carried out using a flow guide 100 as shown by FIG. 14 in apparatus as shown schematically in FIG. 15. The flow guide 100 had a regularly spaced array of pillars 102 of square cross section integral with a base 103. Two edges of the array are completed with pillars 104 which have a triangular cross section. This array of pillars is similar to the array 30 shown in FIG. 2 but with a smaller number of pillars. This flow guide 100 was made of transparent polymer and was located within a surrounding chamber 108 as shown in cross section in FIG. 15. The chamber 108 was formed by two blocks of transparent polymer, 110, 112 held together by bolts which are not shown. The flow guide 100 was in a cavity between the two blocks. There was a liquid inlet 113 to the cavity and a liquid outlet 114. When liquid was pumped through the chamber 108, it flowed through the gaps between the pillars 102. These compelled repeated changes in direction of flow as the liquid flowed through the gaps between pillars (as illustrated by FIG. 4 referred to above) which caused elastic turbulence to occur, if the liquid contained a substance able to display elastic turbulence and the flow velocity was sufficient.

The apparatus shown by FIG. 15 enabled the occurrence of elastic turbulence to be observed utilizing the phenomenon of birefringence. The apparatus has some similarity to apparatus described by Moss G R and Rothstein J P in "Flow of wormlike micelle solutions through a periodic array of cylinders". Journal of Non-Newtonian Liquid Mechanics, Vol 165 pages 1-13, 2010.

Beams from a red LED light 125R and a green LED light 125G were directed along paths, respectively shown as a solid line and as a broken line, towards a video camera 126. The chamber 108 containing flow guide 100 was positioned between linear polarizing filters 128R, 129R set with their polarization directions at right angles (i,e, crossed) and between linear polarizing filters 128G, 129G which were also set with their polarization directions at right angles to each other. Consequently, no light could reach the video camera 126 unless birefringence in the chamber 108 altered the angle of polarization of light passing through the chamber. The filters 128R and 128G were set with their polarization directions at right angles to each other, so that the planes of polarization of the red and green light entering the chamber were at right angles to each other. Dichroic mirrors 130 which pass the red beam and reflect the green beam were used to merge the red and green beams, then to separate them after they have passed through chamber 108, and subsequently to reunite them before they arrive at the camera 126.

Other parts of the apparatus were mirrors 138, lenses 132, red and green bandpass filters 134G and 134R and dichroic mirrors 136 which were set with a 90° difference in rotation with respect to the red beam path in order to cancel rotation of polarization induced due to Fresnel refraction. Such dichroic mirrors were not needed for the green beam because its polarization was such that no rotation of polarization was induced.

Wormlike micelles formed by viscoelastic surfactants are birefringent. Consequently, when these molecules became aligned by liquid flow within the chamber 108 and were illuminated with polarized red and green light, they changed the plane of polarization of the light thereby allowing some of this light to pass through the filters 129R and 129G to the camera, although this did not occur if the alignment of the micelles coincided with the plane of polarization of the light. Providing two light beams with different planes of polarization as they entered the chamber 108 addressed this issue: any micelles aligned with the red polarization would not be aligned with the green polarization and vice versa. Hence the apparatus was sensitive to polarization alignment in any direction.

When there was flow of a liquid containing wormlike micelles through the chamber, these micelles became aligned through extensional flow as the liquid flowed around the pillars 102 of the flow guide 100, and the birefringence from the aligned micelles could be seen as red or green color in pictures or video recorded by the camera 126.

A first experiment was carried out using a solution similar to one mentioned by Moss and Rothstein in the paper above. This solution contained 100 mM (approx. 4 wt %) of the viscoelastic cationic surfactant cetylpyridinium chloride and 50 mM (approx. 0.8 wt %) of sodium salicylate dissolved in a brine of 100 mM (approx. 0.6 wt %) NaCl in distilled water.

Figure 16:
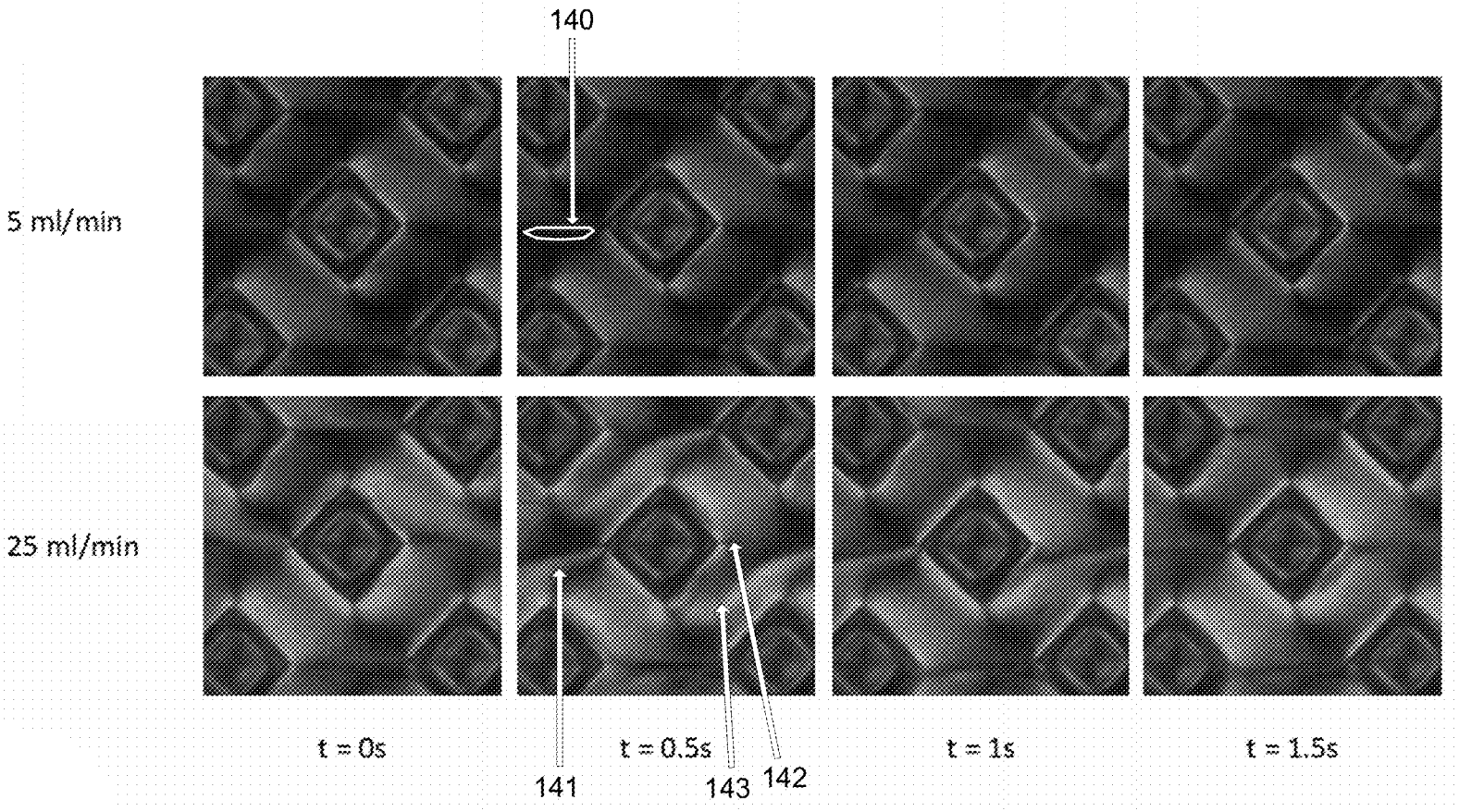
FIG. 16 shows, in greyscale, pictures obtained with the apparatus of FIG. 15.

The viscoelastic solution was pumped through the chamber 108 at a low flow rate of 5 ml per minute. The camera 126 recorded video at twenty frames per second for a period of 5 seconds and the recording showed that the pattern of flow around the pillars 102 of the flow guide 100 remained constant. Four pictures from that video recording, at half second intervals, are shown in grayscale as the top row in FIG. 16 and it can be seen that there was negligible change from one picture to the next. The original colored pictures showed a line of red color extending in the flow direction from the downstream corner of each pillar. A white outline has been drawn around one of these as indicated 140 in one picture. These lines of red color remained at the same intensity and in the same position throughout the video recording. The flow rate was then increased to 25 ml/min and video was again recorded for 5 seconds. This video recording of flow at 25 ml/min was very different from that at 5 ml/min. It showed constant movement, Patches of color, showing where extensional flow was aligning micelles, were constantly moving from one position to another and varying in intensity. Four pictures from the video with 25 ml/min flow rate are reproduced in greyscale as the bottom row of FIG. 16. There were a number of changes from each picture to the next. For instance, arrow 141 points to a patch of red color which was present in one picture but absent from the preceding picture and diminished in the two subsequent pictures. At the position 142 there was an area of red color which was not present in the preceding picture and again diminished in the next two pictures. The second picture in the lower row also showed an intense green area 143, which was not present in the first picture and which largely disappeared in the third picture. Thus it could be seen that flow at 5 ml/min was laminar but at 25 ml/min the flow had become turbulent.

Similar experiments were carried out with solutions containing partially hydrolyzed polyacrylamide of average molecular weight 18 MDa (HPAM) to enable the display of elastic turbulence and containing xanthan as an additional thickening agent, and with comparative solutions containing only xanthan (which was too rigid to cause elastic turbulence, as mentioned above). These polymers do not form micelles but do cause birefringence when aligned. Again elastic turbulence was not observed at a flow rate of 5 ml/min but was observed at faster flow rates. Flow rates and observations are given in the following table which also repeats the comments from the above experiment with viscoelastic surfactant.

| Solutes | Flow rate | Comments concerning pictures |
|---|---|---|
| 4 wt % cetyl pyridinium chloride<br>0.8 wt % sodium salicylate and<br>0.6 wt % sodium chloride | 5 ml/min | Red lines extending downstream from pillars do not change position. No changes in overall appearance |
| | 25 ml/min | Red lines extending downstream from pillars change angle relative to flow direction. Green areas appear, change position and disappear. |
| 0.25 wt % HPAM and<br>0.25 wt % xanthan | 5 ml/min | Red lines extending downstream from pillars do not change position. Green areas do not change. |
| | 15 ml/min, and 30 ml/min | Movement of red areas extending downstream from pillars, prominent green areas appear and change position |

-continued

| Solutes | Flow rate | Comments concerning pictures |
|---|---|---|
| 0.5 wt % xanthan | 5 ml/min, 30 ml/min and 40 ml/min | Red and green areas do not change position at any flow rate |
| 0.25 wt % xanthan | 30 ml/min | Red and green areas do not change position |
| 0.12 wt % HPAM, 0.12 wt % xanthan, 0.465 wt % NaCl | 5 ml/min | Red and green areas do not change position |
| | 45 ml/min | Red and green areas change in shape and position |

It is apparent from these comments that the solution containing HPAM and xanthan displayed elastic turbulence at 15 ml·sec and above, but solutions containing xanthan without HPAM did not display elastic turbulence even at 30 ml/min.

The various embodiments of this disclosure which have been set out above are intended to assist understanding of this disclosure, but not to limit in any way the scope of this disclosure as defined by the following claims. It should be appreciated that any features or possibilities described in combination may, where it is practical to do so, be used individually. Also, features or possibilities mentioned in the following claims or described in any embodiment may be used in any other embodiment, in so far as it is practical to do so and in particular where two or more of the following claims are dependent on the same preceding claim, the reader should understand that the present disclosure includes any possible combination of any two or more or all of those dependent claims with each other and with that preceding claim.

The invention claimed is:

1. A method of moving heat into or out of a flowing fluid, comprising:

pumping the flowing fluid through a heat transfer device, wherein the heat transfer device comprises a chamber for through flow of the flowing fluid, wherein a chamber wall in contact with the flowing fluid is an interface through which heat energy is transferred to or from the flowing fluid, wherein the chamber contains an array of spaced obstructions compelling the streamlines of the flowing fluid to repeatedly change direction in order to flow through gaps between the obstructions, wherein the flowing fluid contains a solute which enables the flowing fluid to display elastic turbulence, wherein a flow rate of the flowing fluid in the chamber is such that the flowing fluid is in a state of elastic turbulence, wherein the viscosity of the flowing fluid, the flow rate of the flowing fluid within the chamber, and a width of the gaps between obstructions give a Reynolds number (Re) for the flowing fluid which is in a range from 1 to 1000, and wherein the flowing fluid is an emulsion with a continuous phase which is a solution of the solute which enables the flowing fluid to display elastic turbulence and a suspended disperse phase which changes between solid and liquid at temperatures where the continuous phase is liquid.

2. The method of claim 1, wherein the heat transfer device is part of a heat exchange system comprising:

a second heat transfer device at a different location;

a pump; and pipework connecting the pump and the heat transfer devices as a closed circuit containing the flowing fluid.

3. The method of claim 1, wherein the solute which enables the flowing fluid to display elastic turbulence is a polymer containing at least 5,000 monomer units in one or more linear polymer chains each containing at least 1000 monomer units, connected one to the next by a single covalent bond so that one monomer unit can rotate relative to adjoining monomer units.

4. The method of claim 1, wherein the solute which enables the flowing fluid to display elastic turbulence is a polymer with a molecular weight above $10^6$ Daltons.

5. The method of claim 4, where the polymer contains a linear chain of at least 5000 monomer units.

6. The method of claim 5, wherein the polymer is a polyacrylamide or polyacrylamide derivative.

7. The method of claim 1, wherein the solute which enables the flowing fluid to display elastic turbulence is a worm-like micellar surfactant system comprising one or more aggregating molecule species.

8. The method of claim 1, wherein the chamber has a volume of at least 50 ml.

9. The method of claim 1, wherein the continuous phase is an aqueous solution of the solute containing not more than 5% by weight of the solute which enables the flowing fluid to display elastic turbulence.

10. The method of claim 1, wherein the suspended disperse phase melts above −80° C. and below 150° C.

11. The method of claim 1, wherein the continuous phase is an aqueous solution of the solute which enables the flowing fluid to display elastic turbulence.

12. The method of claim 1, wherein the suspended disperse phase comprises one or more aliphatic organic compounds containing alkyl groups of at least 12 carbon atoms.

13. The method of claim 12, wherein the suspended disperse phase comprises one or more saturated alkanes of at least 14 carbon atoms.

14. The method of claim 1, wherein the spaced obstructions extend across the chamber from the interface to an opposing chamber wall spaced from the interface.

* * * * *